US005641277A

United States Patent [19]

Gondek

[11] Patent Number: 5,641,277

[45] Date of Patent: Jun. 24, 1997

[54] PERISTALIC PUMP

[76] Inventor: John T. Gondek, 1641 Innsbruck Circle West, Columbia Heights, Minn. 55421

[21] Appl. No.: 489,978

[22] Filed: Jun. 13, 1995

[51] Int. Cl.[6] ..... F04B 43/09

[52] U.S. Cl. ..... 417/477.9; 417/477.1

[58] Field of Search ..... 417/477.1, 477.9, 417/477.2–477.8, 477.11–477.14; 604/153

[56] References Cited

U.S. PATENT DOCUMENTS

| | | | |
|---|---|---|---|
| 3,358,609 | 12/1967 | Worth et al. | 417/477.6 |
| 3,644,068 | 2/1972 | Lepak | 417/477.7 |
| 4,417,856 | 11/1983 | Minissian | 417/477.7 |

FOREIGN PATENT DOCUMENTS

| | | | |
|---|---|---|---|
| 2076068 | 11/1981 | United Kingdom | 417/477.9 |

OTHER PUBLICATIONS

Stoelting model 219 Mix Pump Owner's Manual No. 1134067. Revised Jun. 1985 (31 pages).
Hajec handwritten memorandum dated Aug. 2, 1993.
Stoelting P.O. 16069–00 dated Aug. 4, 1993 to Vikeland ordering 10 ice cream mix and air pump per Jul. 8, 1993 B. GOCH requirement memo with .100" wall.
Falcon Electric Corp. Aug. 10, 1993 letter.
Falcon Electric Corp. Aug. 12, 1993 letter.
Vikeland (Kletch) Sep. 2, 1993 memorandum to Hajec (2 pages).
Stoelting Dec. 22, 1993 trip report (7 pages).
Stoelting PO81180–00 dated Mar. 7, 1994 for 50 U3 Ultima Pumps.
Stoelting May 5, 1994 letter to Chet Hajec (Vikeland).
Hajec May 16, 1994 letter to Stoelting.
Stoelting May 23, 1994 letter to Chet Hajec (Vikeland).
Stoelting Oct. 4, 1994 letter to Chet Hajec (2 pages).
Stoelting Oct. 14, 1994 memoradum (4 pages).
Stoelting Nov. 30, 1994 letter to Chet Hajec.
Stoelting Jan. 5, 1995 memorandum (3 pages).
Stoelting PO 88009–00 dated Jan. 26, 1995.
Stoelting PO 88011–00 dated Jan. 26, 1995.
Stoelting Feb. 27, 1995 memorandum (2 pages).
Stoelting Mar. 16, 1995 memorandum (3 pages).
Stoelting Mar. 29, 1995 letter to Chet Hajec (2 pages).
Stoelting Apr. 4, 1995 letter to Falcon Electric.
Stoelting Apr. 17, 1995 letter to Falcon Electric.
Stoelting May 9, 1995 letter to Falcon Electric (5 pages).
Stoelting May 17, 1995 letter to Falcon Electric (2 pages).
Stoelting May 18, 1995 letter to B. Linnerooth (Falcon Electric) (3 pages).
Chester S. Hajec Declaration.

*Primary Examiner*—Timothy Thorpe
*Assistant Examiner*—Peter G. Kurytnyk
*Attorney, Agent, or Firm*—Roger W. Jensen

[57] ABSTRACT

A peristalic pump includes a frame supporting a rotatable shaft on which is mounted a rotor having at least two rollers mounted thereon for rotation about axes parallel to the shaft axis. A pump housing surrounds the rotor and is formed by a pair of substantially identical body members positioned in facing, abutting relationship. Each body member has an annular portion with a flat axial end surface and an inner circumferential surface, as well as a tube guide and clamp tang portion integral with the annular portion and extending radially outwardly therefrom. Each tube guide and clamp tang portion has a pair of spaced-apart half-round grooves extending to the inner circumferential surface. Each member has a shoulder which extends radially inwardly from one axial end of the annular portion. When the members are assembled in facing, abutting relationship, they define a substantial annular opening for receiving the pump rotor, and the inner circumferential surfaces form a common circumferential surface bounded at each axial end by one or the shoulders. Further, the half-round grooves form a pair of spaced-apart round passageways. Flexible, compressible, hollow tube means are positioned in the passageways and abut the common circumferential surface between the pump housing and the rollers. Additional means selectively lock the tube means with respect to the housing.

13 Claims, 7 Drawing Sheets

PERISTALIC PUMP

CROSS-REFERENCES TO RELATED APPLICATIONS

This application is related to two additional patent applications filed by the Applicant concurrently with this application, i.e., Ser. No. 08/489,977 entitled "Variable Volume Air Pump" and Ser. No. 08/490,091, entitled "Combined Variable Volume Air Pump and Peristalic Pump", both now allowed.

BACKGROUND OF THE INVENTION

The field of peristalic pumps is, on the one hand, fairly well developed. However, the peristalic pumps known to the Applicant have various shortcomings. Examples of prior art peristalic pumps include those shown in U.S. Pat. Nos. 3,358,609; 4,138,205; 4,179,249; 4,231,725; and 4,552,516. For example patents '249, '725 and '516 show peristalic pumps which employ a rotor having a plurality of compression surfaces operative to cause peristalic action on a compressible flow tube; these patents further have a means for loading or adjustment of a compressible flow tube relative to the pump rotor. These prior art pumps use reaction surfaces on moveable reaction members, termed "clam shells", which are moved between an open position which permits loading and removal of a compression tube, and a closed position where the tube is held in a predetermined position to facilitate peristalic pumping; a disadvantage of these prior art pumps is that a significant amount of time is required to first stop the pump and then operate the clam shells so as to change or adjust the compression tube.

SUMMARY OF THE INVENTION

The present invention may be described as a peristalic pump comprising a frame and a shaft rotatably supported by the frame. A peristalic pump housing is mounted on the frame, the housing having a pair of substantially identical body members positioned in facing, abutting relationship. Each of the body members has an annular portion having an axial end flat surface and an inner bore having an inner circumferential surface. Each body member has a tube guide and clamp tang portion integral with the annular portion and extending radially outwardly therefrom, the tube tang portion having a flat surface which is an extension of the aforementioned flat axial end surface of the annular portion. Each of the body members has a pair of spaced-apart half-cylindrical grooves depending from said flat surface of the tube guide and clamp tang portion, the grooves extending radially therethrough to said inner periphery of the annular portion. In addition, the tang portion has a recess or clamp deflection step from said flat surface at an outer extremity thereof. Finally, each of the body members has a shoulder which extends radially inwardly from the outer axial end of the inner bore or periphery. Thus, when the substantially identical body members are positioned in facing, abutting relationship, they jointly define a substantial annular opening for receiving a pump rotor means, and the inner circumferential surfaces jointly form a circumferential track bounded at each axial end thereof by the shoulders which extend radially inwardly. Also, the half-cylindrical grooves are in register with one another so that they jointly form a pair of spaced-apart passageways, each having a circular cross-section. The pump further includes a rotor mounted on the shaft and positioned in the substantial annular opening of the pump housing. At least two rollers are mounted on the rotor for rotation about axes parallel to the shaft axis. Finally, a flexible, compressible, hollow tube means is positioned in the passageways and also abutting the circumferential track positioned between the pump housing and the rollers. When the rotor is rotating by the shaft, fluids are pumped through the tube in the well known peristalic manner, the dimensions of the tube, track, rotor and rollers being all pre-selected so that the tube is squeezed between the rollers and the track.

My invention permits rapid loading and removal of the flexible tube from the pump without disassembly and without stopping the pump. Once the tube is in proper position, it is then held in place through the use of a clamping means, drawing or deflecting together the outboard ends of the tube support portions of the body members so as to clamp the tube, this being facilitated by the aforesaid clamp deflection steps from the flat surfaces described above.

It is an object of this invention, therefore, to provide an improved peristalic pump. Other objects and advantages of this invention will become apparent to those skilled in the art from the following description of the preferred embodiment of the invention taken in connection with the accompanying drawings.

DESCRIPTION OF THE PREFERRED EMBODIMENT

Figure 1:
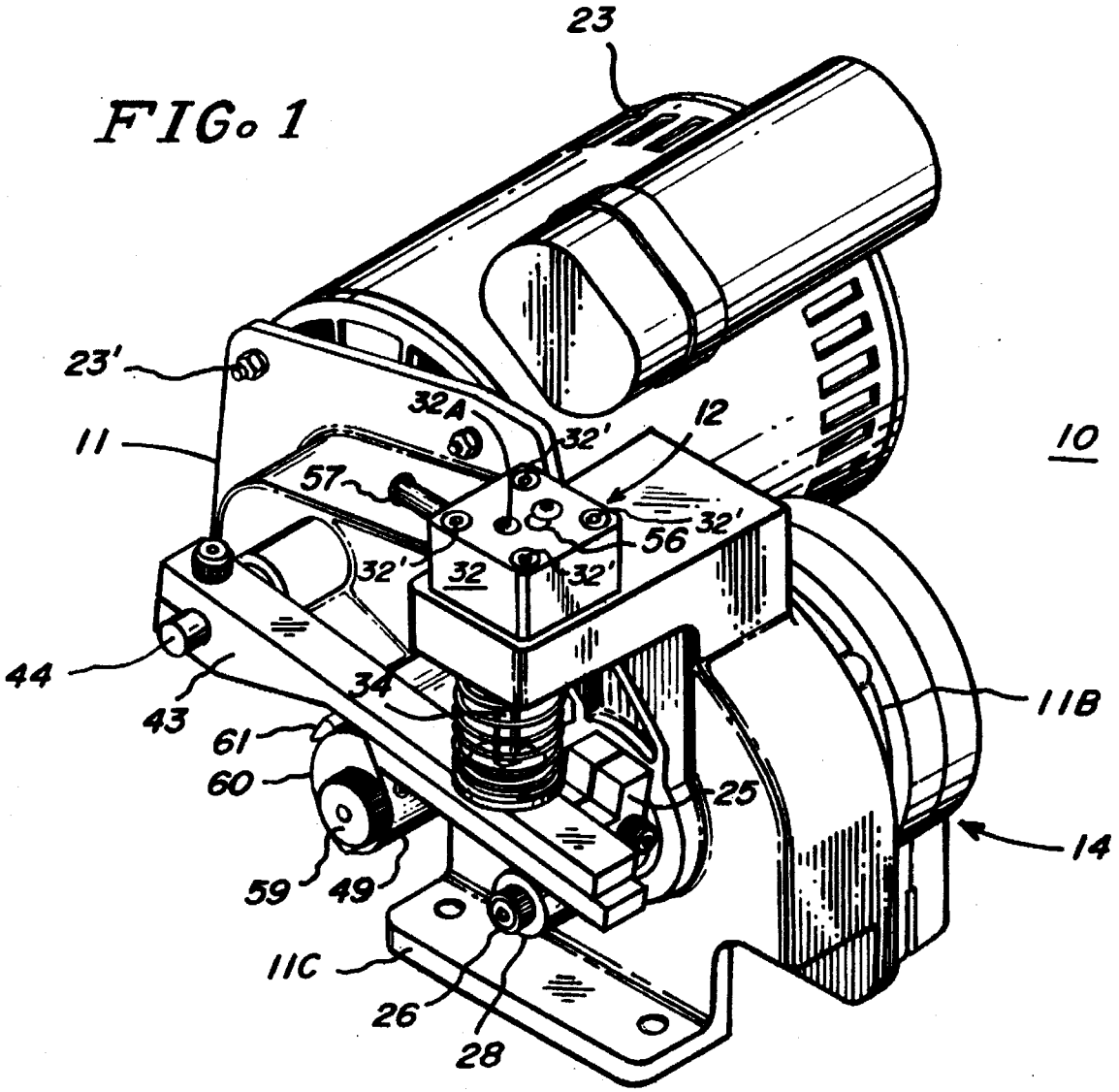
FIG. 1 is an isometric view of the improved pump in combination with additional apparatus which are the subject matter of said co-pending applications.
Figure 2:
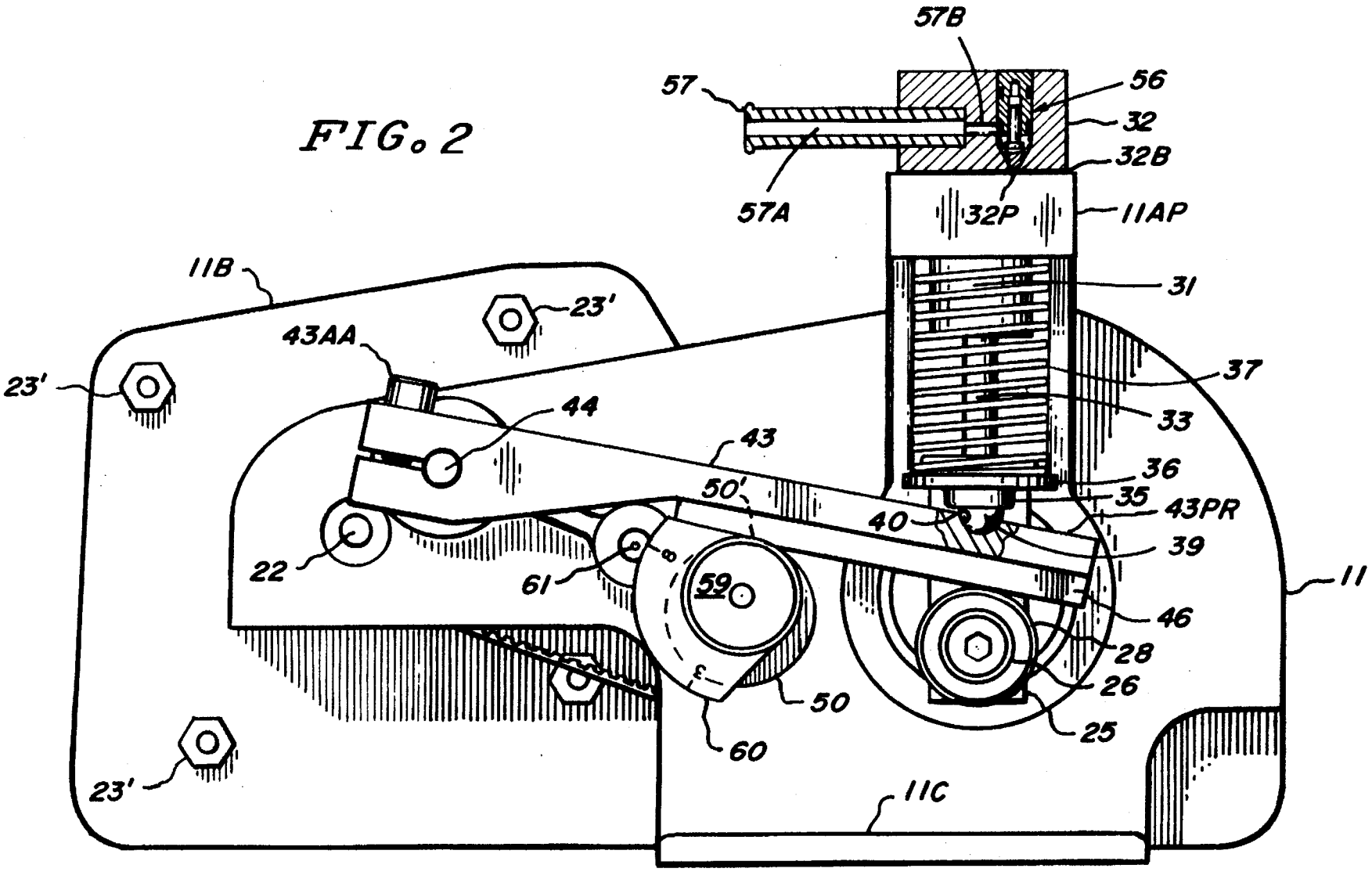
FIG. 2 is a left side view, partly in section, of the apparatus.
Figure 3:
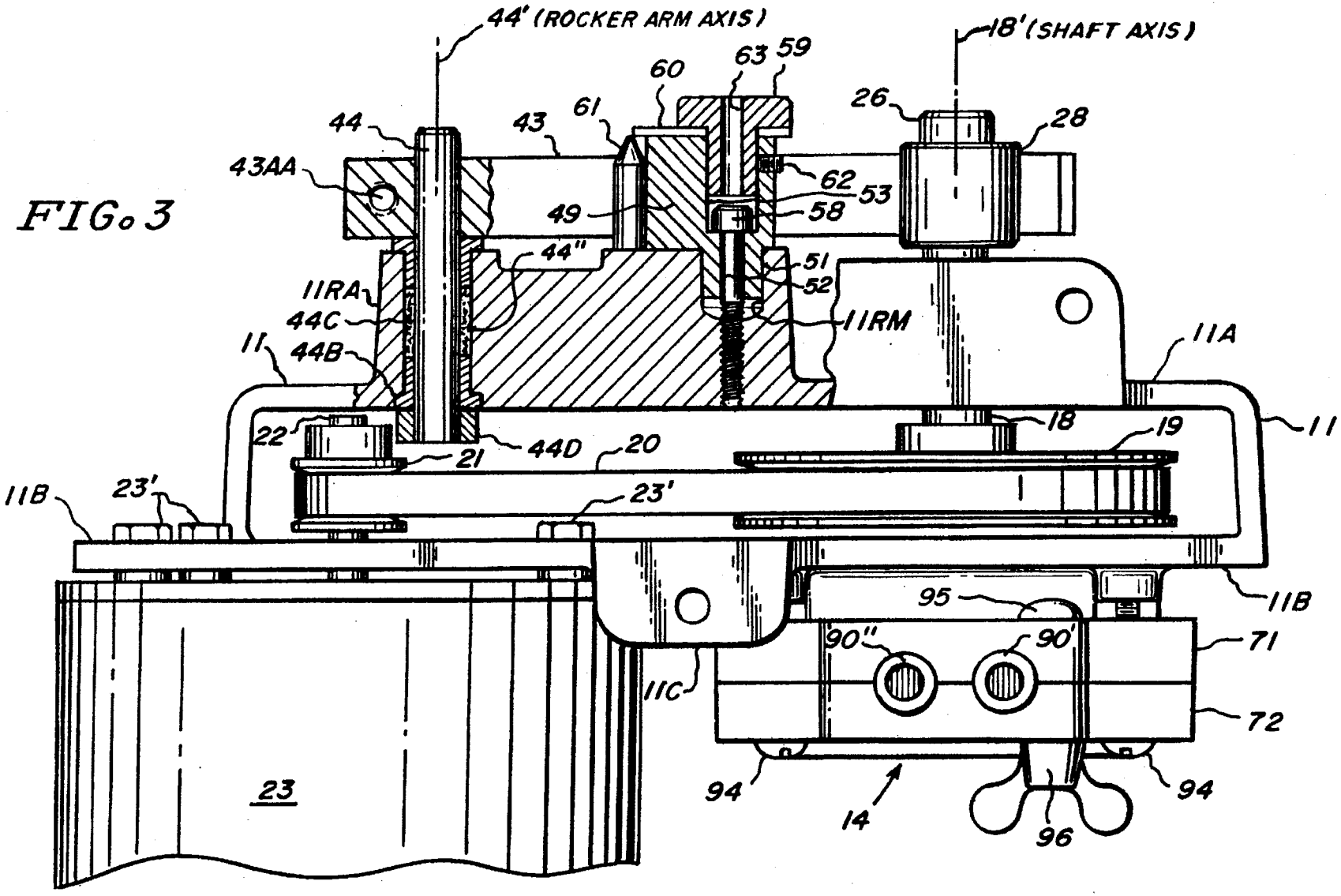
FIG. 3 is a bottom view, partly in section, of the apparatus.
Figure 4:
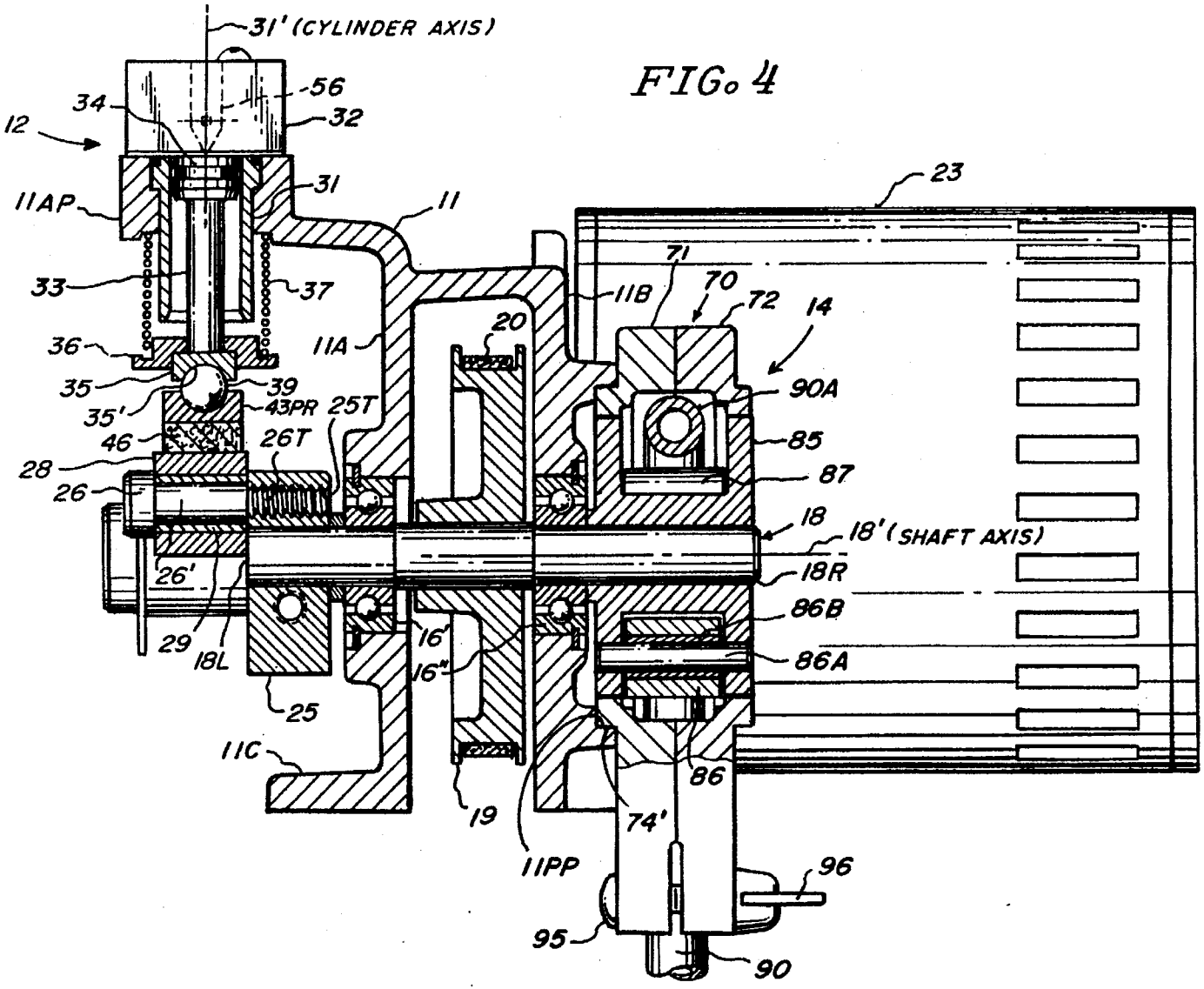
FIG. 4 is a vertical cross-section of both the air pump and the peristalic pump as viewed along section lines 4AA—4AA of FIG. 5, this figure shows the rollers of the peristalic pump in one position about the rotational axis and the tube uncompressed.

In FIG. 1, reference numeral 10 designates a combined air pump 12 and a peristalic pump 14, both mounted on the same common frame member 11. The frame 11 is a complex structure, a portion of which is shown in cross-section in FIG. 4 comprising a pair of spaced-apart parallel wall portions 11A and 11B. A pair of spaced-apart pedestals or mounting feet 11C and 11C' are provided as shown in FIGS. 2, 3 and 4. Centrally positioned in portions 11A and 11B of the frame are a pair of ball bearings 16' and 16", respectively, which support a shaft 18 for rotation about a shaft axis 18'. Means for rotating the shaft 18 include a large pulley 19 fixed to shaft 18 and positioned between portions 11A and 11B of the frame. A pulley belt 20 engages the operative driving surface of pulley 19 and extends to engage with a smaller pulley 21 shown in FIG. 3, and which is fixed to a motor shaft 22 of a motor 23, which in turn is attached to frame wall portion 11B by suitable fastening means 23'. In the preferred embodiment, the motor means 23 is a single phase, AC electric motor which, when energized, will drive shaft 22 at a constant angular velocity and, thus, through the pulley 21, belt 20 and pulley 19 drive the shaft 18 at a slower, but constant, angular velocity. As viewed in FIG. 4, the left end of the shaft 18 is identified as reference 18L and the right end by reference 18R. The apparatus driven by the left end 18L of shaft 18 is the subject matter of the above-identified co-pending application entitled "Variable Volume Air Pump".

Figure 6:
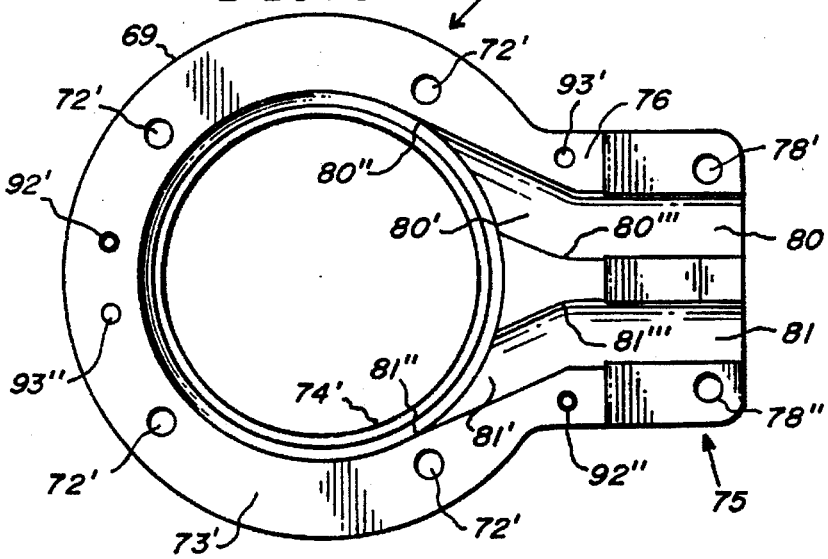
FIG. 6 is a plan view showing the mating face or inner axial end of one of the pairs of substantially identical body members.
Figure 8:
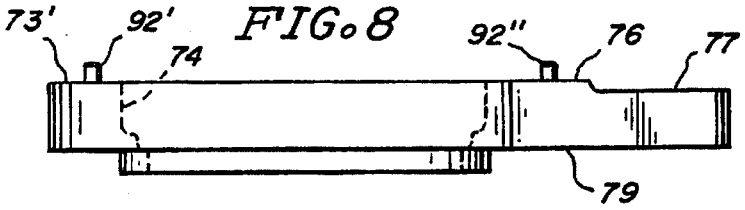
FIG. 8 is a side view of the apparatus shown in FIG. 6.
Figure 9:
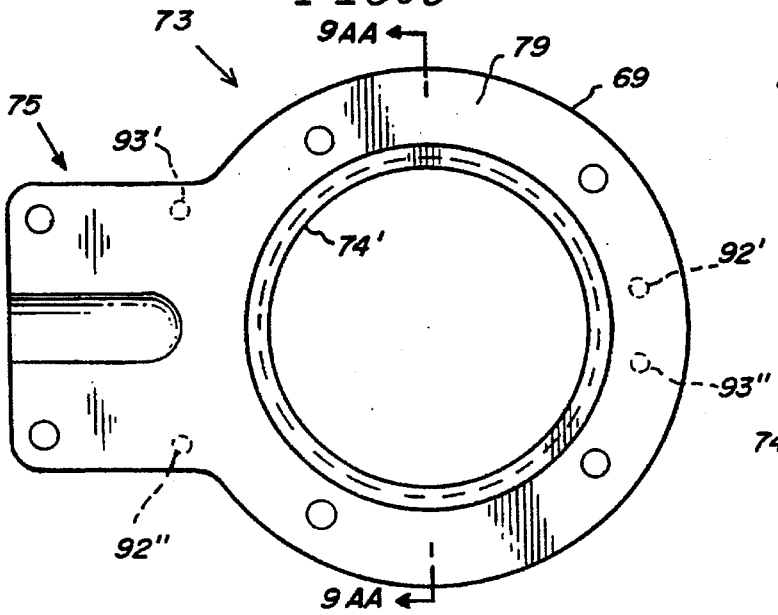
FIG. 9 is a plan view, showing the outer axial end or mounting face end of one of the body members.

Extending axially outward from portion 11B of frame 11 is a rabbet frame extension 11PP (see FIG. 4), the outer axial surface of which defines a flat mounting surface. The bore or rabbet 11PP is concentric with the shaft axis 18'. A pump housing 70 is mounted on the frame 11 and comprises in part a rabbet 74' which fits into frame rabbet 11PP. The pump housing is comprised of a pair of identical body members 71 and 72 positioned in facing, abutting relationship, as shown in FIG. 4. The body members are shown in detail in FIGS. 6–9AA. Each of the body members comprises an annular portion 73 (see FIGS. 6 and 9) having a flat axial end surface 73' (see FIGS. 7 and 9AA), this being termed the "mating face" of the body. The other or opposite axial end or mounting face of each body member is identified by reference numeral 79 (see FIG. 7). Each of the annular portions 73 has an inner circumferential surface 74 (see FIG. 9AA), as well as a tube guide and clamp tang portion 75 which is integral with the annular portion and depends radially outwardly therefrom. The inner circumferential surface 74 of the annular portions 73 provide a roller carder clearance bore. Tang portion 75 has a flat surface 76 which is an extension of said flat surface 73', as is clearly shown in FIG. 8. However, there is a clamp deflection step 77 at the outer radial extremity of tube guide and clamp tang portion 75 and is best shown in FIG. 8. A pair of holes 78' and 78" extend through the step 77 of the tube guide and clamp tang portion 75 as shown in FIG. 6. Also, a plurality of holes 72' extend through the annular portion 73 as shown in FIG. 6.

Figure 7:
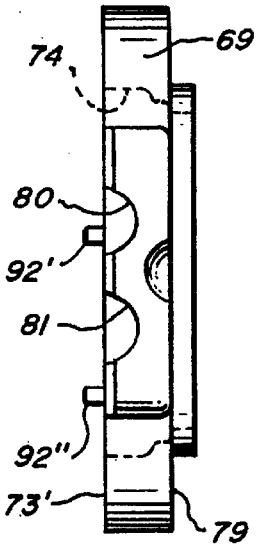
FIG. 7 is a right side end view of the apparatus shown in FIG. 6.

The body members 71 and 72 are further characterized by each having a pair of spaced-apart half-cylindrical grooves 80 and 81 shown in FIGS. 6 and 7, which depend from the flat surface 76 and extend from the outboard end of tang portion 75 radially inwardly through said radially extending portion 75 to midpoints where grooves 80 and 81 connect with rounded turns 80'" and 81'" which, in turn, connect groove continuations 80' and 81' which, in turn, tangentially connect with the inner circumferential surface 74 of the annular portion at 80"0 and 81", respectively, as shown in FIG. 6.

Figure 9A:
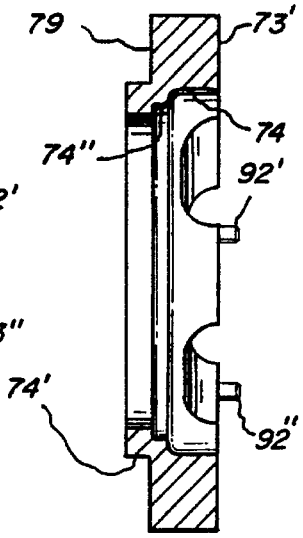
FIG. 9AA is a cross-section view of the device shown in FIG. 9 as viewed along section lines 9AA—9AA thereof.

As shown in FIG. 9AA, each body member 71 and 72 further includes a rabbet or shoulder 74' radially extending inwardly from the inner circumferential surface 74 and at the mounting face end 79 thereof. An intermediate shoulder 74" is positioned between surface 74 and shoulder 74' (see FIG. 9AA). Shoulder or rabbet 74' also projects axially outward and has an outer diameter pre-selected to fit within the aforementioned rabbet 11PP of frame 11 as shown in FIG. 4.

Figure 4A:
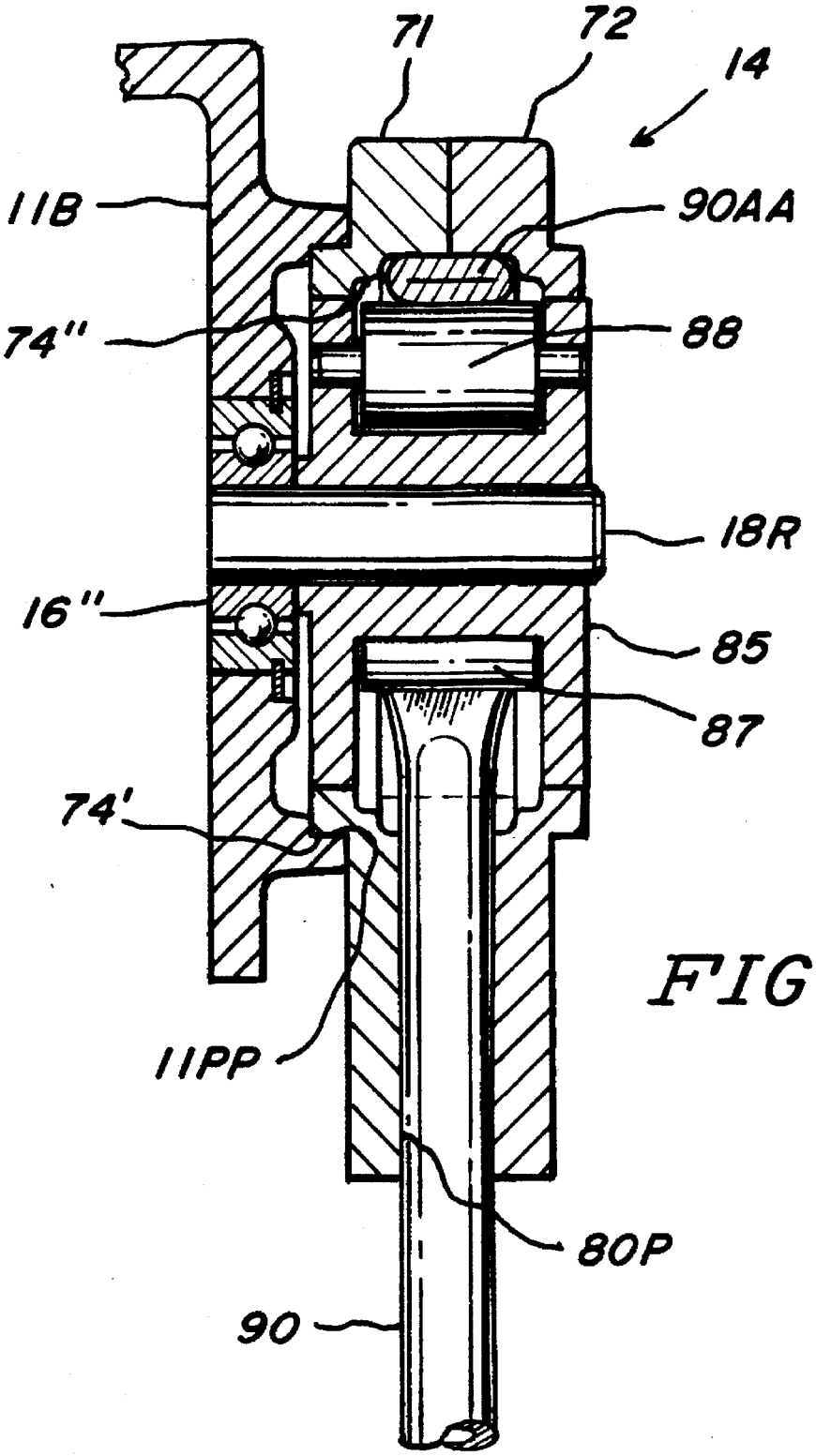
FIG. 4AA shows a cross-section of the peristalic pump with a roller in the upper most position and with the tube squeezed between the roller and the circumferential track as viewed along section lines 4AA—4AA of FIG. 5.

The pump housing is characterized, when the body members 71 and 72 are positioned with the mating face surfaces 73' in facing, abutting relationship, to define a substantial annular opening for receiving a pump rotor carrier means. The inner circumferential surfaces 74 of body members 71 and 72 jointly form a continuous circumferential track bounded at each axial end by the radially inwardly extending shoulders 74' and 74" as is clearly shown in FIG. 4. Each member 71 and 72 has a pair of dowels 92' and 92" (see FIG. 7) projecting up from the mating face surface 73 and tang surface 76 and which fit into mating dowel holes 93' and 93", respectively, (see FIG. 6) to align the members 71 and 72. Further, the half-round grooves 80—80' and 81—81', being in register with one another, form a pair of spaced-apart round tube passageways, one of which 80P is shown in FIG. 4AA.

Referring to FIG. 4, a rotor 85 is mounted on and fixed with a pressed fit to shaft 18 at end 18R thereof and is positioned in the above-mentioned bore of the pump housing. The rotor 85, in the preferred embodiment, has three separate identical rollers 86 and 87 shown in FIG. 4 and 88 shown in FIG. 4AA mounted thereon for rotation about axes parallel to the shaft axis 18'. For example, referring to FIG. 4, roller 86 is supported on rotor 85 by a shaft 86A and sleeve bearing means 86B for rotation about an axis defined by shaft 86A parallel to the shaft axis 18'. In FIG. 4, the top of one of the other rollers 87 is partially visible.

Flexible, compressible, hollow tube means 90 is positioned in the 80-81 round passageways and abuts the combined circumferential surfaces 74 and lies between the pump housing track and the rollers carried by rotor 85. In FIG. 4, the reference numeral 90A designates the tubing in its uncompressed state. In FIG. 4AA, the reference numeral 90AA depicts the tubing 90 as fully compressed by the roller 88.

Figure 5:
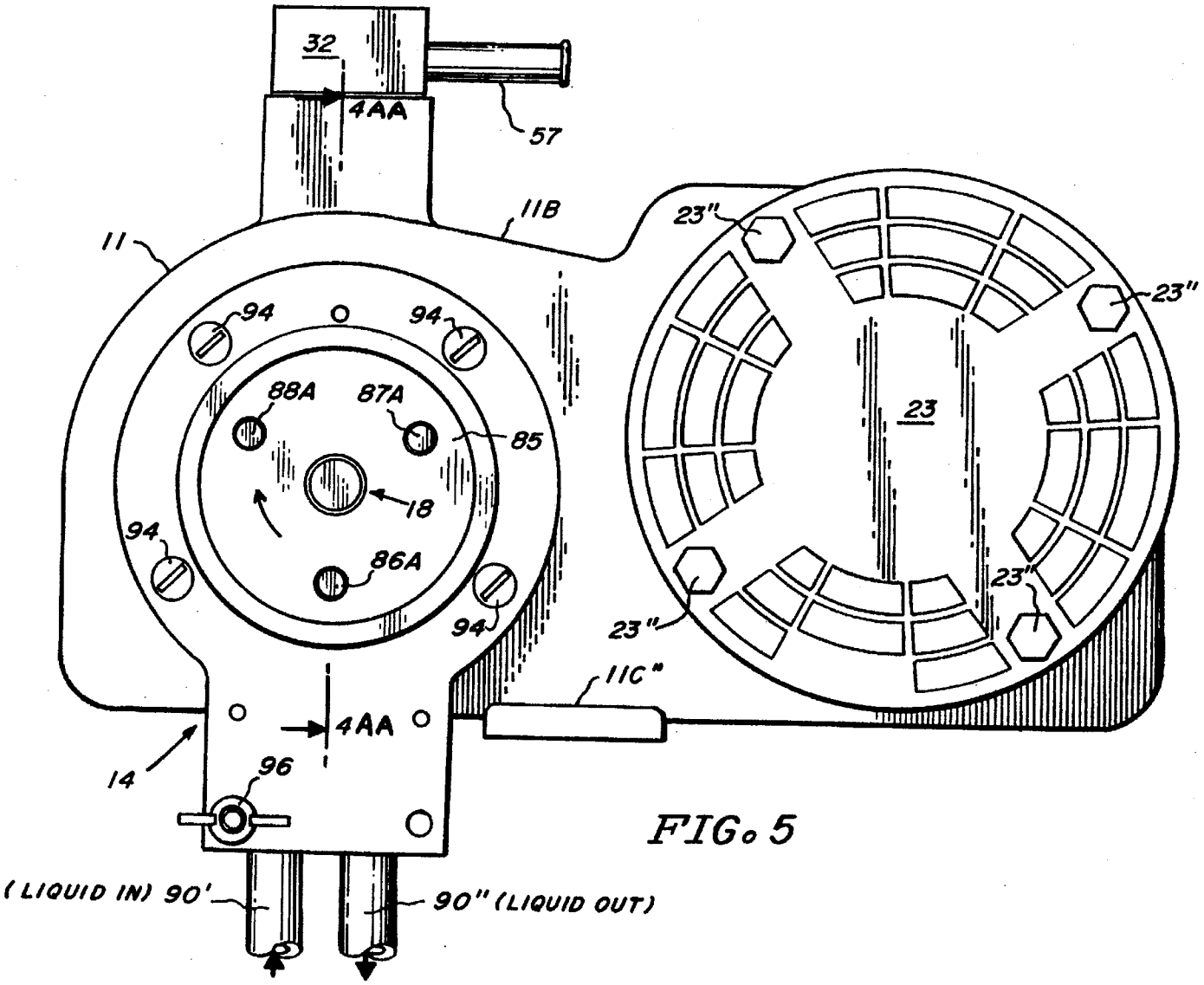
FIG. 5 is a right side view of the apparatus.

The body members 71 and 72 are adapted to be assembled as aforesaid, the faces 73' in abutting relationship, and dowels 92' and 92" co-acting with mating dowel holes 93' and 93" to align the body members one with the other. The resultant sub-assembly then is attached to the frame as shown in FIGS. 3, 4 and 5 by the use of suitable machine screws 94 passing through holes 72' and screwed into threaded holes in frame 11B. A carriage bolt 95 passing through one of the clamp screw holes 78' or 78" and a companion wing nut 96 can be used to draw or deflect together the extreme outer tips of the tube support portions 75 of the body members so as to clamp the tubing 90, the steps 77 (see FIG. 8) facilitating the deflection and thus the clamping action (see also FIG. 4).

The body members may be made of any suitable plastic or other material.

OPERATION

Assuming that motor 23 is energized, shaft 18 will then be rotating at a relatively constant angular velocity in the direction shown by the arrow adjacent to shaft 18 in FIG. 5. In FIG. 5, the inlet portion of tubing 90, through which liquid is drawn into the pump, is identified by reference numeral 90 and the output or discharge section of the tubing is identified by reference number 90". With the rotor 85 rotating as aforesaid about axis 18', the rollers 86, 87 and 88 (see FIGS. 4 and 4AA) will roll around and squeeze the tubing 90, as described above, so as to pump liquid out through discharge portion 90" of the pump.

In order to load tubing into the pump, the motor 23 must be running and the wing nut 96 loosened so as to permit the tubing to be inserted into the pump body. The tubing is fed through one of the passageways. The rotation of the rollers will facilitate feeding the tubing by gripping the tubing around and adjacent to the continuous circumferential surface and thence out through the other passageway. Once the tubing is positioned as desired, the wing nut 96 is then tightened down so as to pinch the tubing, as aforesaid, and hold it in place with respect to the pump housing. In the preferred embodiment, the roller bearing means are preferably oil-less sleeve bearings (rather than ball bearings); sleeve bearings have a higher, pre-selected level of friction which will assist in gripping the tubing during the loading of the tubing. Thus the tubing may be very quickly adjusted or replaced without stopping the motor. This is a major advantage of my invention over the prior art peristalic pumps which require shutdown and partial disassembly so as to adjust or replace the tubing.

The grooves 80—80' and 81—81' of FIGS. 6 and 7 are sized slightly larger than the tubing means 90.

The tubing 90 is thus snugly supported by the grooves 80—80' and 81—81' throughout the tube guide and clamp tang portion 75 up to tangential entry (and exit) of the track formed by the surfaces 74. This facilitates the tubing being centered (as shown in FIG. 4) and reduces tubing wear.

I claim:

1. A peristalic pump comprising:

a) a frame having a flat mounting surface;

b) a shaft rotatably supported by said frame for rotation about an axis perpendicular to said mounting surface;

c) a pump housing rabbeted into said frame and abutting said flat mounting surface, said pump housing having a pair of substantially identical body members positioned in facing, abutting relationship, each of said body members comprising:

i) an annular portion having a flat axial end surface and an inner circumferential surface, ii) a tube guide and clamp tang portion integral with said annular portion and depending radially outwardly therefrom, said guide and clamp tang support portion having a flat surface, iii) a pair of spaced-apart half-cylindrical grooves depending from said flat surface of said tube guide and clamp tang portion and extending radially therethrough to said inner circumferential surface of said annular portion, said tube guide and clamp tang portions further being stepped from said flat surface thereof at the outer radial portion thereof, and iv) a shoulder radially extending inwardly from one axial end of said annular portion, said pump housing being characterized, when said body members are positioned with said flat axial end surfaces in facing, abutting relationship, as aforesaid, by defining a substantial annular opening for receiving a pump rotor means, and said inner circumferential surfaces forming a circumferential surface bounded at each axial end by one of said radially extending shoulders, and said grooves forming a pair of spaced-apart round passageways;

d) a rotor mounted on said shaft and positioned in said substantial annular opening of said pump housing, said rotor having at least two rollers mounted thereon for rotation about axes parallel to said shaft axis; and e) flexible, compressible, hollow tube means positioned in said passageways and abutting said circumferential track between said pump housing and said rollers;

whereby fluids may be pumped through said tube when said rotor is rotated, the dimensions of said tube, said circumferential track, said rotor and said rollers being pre-selected so that said tube is squeezed between said rollers and said track.

2. Apparatus of claim 1 further including a means for locking said tube means with respect to said pump housing.

3. Apparatus of claim 2 further characterized by said locking means including means for applying force to said tube guide and clamp tang portions, tending to deflect them toward one another.

4. Apparatus of claim 3 further characterized by said force applying means comprising screw and nut means extending through said tube guide and clamp tang portions at said recessed outer radial extremities thereof.

5. Apparatus of claim 1 further characterized by each of said shoulders being axially spaced from said flat axial end surface.

6. A peristalic pump comprising:

a) a frame;

b) a shaft rotatably supported by said frame;

c) a pump housing rabbeted into said frame, said pump housing having a pair of substantially identical body members positioned in facing, abutting relationship, each of said body members comprising:

i) an annular portion having a flat axial end surface and an inner circumferential surface, ii) a tube guide and clamp tang portion integral with said annular portion and extending radially outwardly therefrom, iii) a pair of spaced-apart half-round grooves depending from a surface of said tube guide and clamp tang portion and extending radially therethrough to said inner surface of said annular portion, and iv) a shoulder radially extending inwardly from one axial end of said outer portion, said pump housing being characterized, when said body members are positioned with said flat axial end surfaces in facing, abutting relationship, as aforesaid, by defining an annular opening for receiving a pump rotor means, and said inner circumferential surfaces forming a circumferential surface bounded at each axial end by one of said radially extending shoulders, and said grooves forming a pair of space-apart round passageways;

d) a rotor mounted on said shaft and positioned in said annular opening of said pump housing, said rotor having at least two rollers mounted thereon for rotation about axes parallel to said shaft axis; and e) flexible, compressible, hollow tube means positioned in said passageways and between said pump housing and said rollers;

whereby fluids may be pumped through said tube when said rotor is rotated, the dimensions of said tube, said circumferential track, said rotor and said rollers being pre-selected so that said tube is squeezed between said rollers and said track.

7. Apparatus of claim 6 further characterized by said frame having a flat mounting surface and said pump housing abutting said surface.

8. Apparatus of claim 7 further characterized by said annular portion having an annular configuration, and said tube guide and clamp tang portion having the same flat surface as said flat axial end surface or said outer portion.

9. Apparatus of claim 8 further characterized by including a means for locking said tube means with respect to said pump housing.

10. Apparatus of claim 9 wherein said locking means comprises a means for applying force to said tube guide and clamp tang portions, tending to deflect them toward one another.

11. Apparatus of claim 10 including motor means mounted on said frame and connected to rotate said shaft.

12. Apparatus of claim 7 further characterized by said frame and pump housing have co-acting rabbet means to position said circumferential surface concentric with said shaft.

13. Apparatus of claim 12 further characterized by said rollers including oil-less sleeve bearings.

* * * * *